US005775552A

United States Patent [19]

Pleschiutschnigg

[11] Patent Number: 5,775,552

[45] Date of Patent: Jul. 7, 1998

[54] POURING SPOUT

[75] Inventor: Fritz-Peter Pleschiutschnigg, Duisburg, Germany

[73] Assignee: Mannesmann Aktiengesellschaft, Dusseldorf, Germany

[21] Appl. No.: 817,320

[22] PCT Filed: Sep. 7, 1995

[86] PCT No.: PCT/DE95/01266

§ 371 Date: Apr. 7, 1997

§ 102(e) Date: Apr. 7, 1997

[87] PCT Pub. No.: WO96/11078

PCT Pub. Date: Apr. 18, 1996

[30] Foreign Application Priority Data

Nov. 7, 1994 [DE] Germany ..... 44 36 990.5

[51] Int. Cl.[6] ..... B22D 11/10

[52] U.S. Cl. ..... 222/607; 222/606; 164/437

[58] Field of Search ..... 222/590, 606, 222/607; 266/236; 164/437, 337

[56] References Cited

U.S. PATENT DOCUMENTS 5,402,993 4/1995 Hofmann et al. ..... 222/606

5,603,860 2/1997 Hohenbichler ..... 222/607

*Primary Examiner*—Scott Kastler

*Attorney, Agent, or Firm*—Cohen, Pontani, Lieberman & Pavane

[57] ABSTRACT

A pouring spout to for delivering molten steel into a continuous casting mold with longitudinal and transverse sides, especially for casting thin slabs. The outer wall (12) of the pouring spout (10) is shaped in its longitudinal-side region (17) facing the longitudinal mold side (21) so that is has a substantially constant distance (d) relative to the longitudinal sides (21) of the mold, regardless of the immersion depth of the pouring spout into the melt in the continuous casting mold. In addition, the outer wall of the pouring spout, in its transverse-side regions (16) facing the transverse mold sides (22), has form elements that oppose a minimum resistance to the horizontal flow of the molten steel and the casting powder floating thereon.

12 Claims, 3 Drawing Sheets

POURING SPOUT

BACKGROUND OF THE INVENTION

1. Field of the Invention

The present invention relates to an pouring spout or a submerged nozzle for delivering molten steel into a continuous casting mold with longitudinal and transverse sides, especially for casting thin slabs, which is connected at one end to a casting vessel and at the other end extends so far into the mold that its opening is immersed during casting into the molten steel in the mold.

2. Description of Related Art

Typically, pouring spouts have a round, substantially circular or elliptical shape at their connection to the casting vessel. This shape may continue to the opening region of the pouring spout or may change into a different shape, for example, a rectangular shape. For example, a pouring spout is known and described in German patent publication OS 24 42 187 in which at least the section that is immersed into the melt has substantially rectangular outer and inner cross-sections. The longitudinal edges of this pouring spout are parallel to the longitudinal sides of the continuous casting mold, so that, particularly in the case of rectangular strand cross-sections, an optimal space is used for the flow cross-section.

The flow cross-section that is available between the transverse side of the mold and the outer wall of the pouring spout in the case of normal slabs does not exist in molds for manufacturing thin slabs. Furthermore, given the casting outputs required today, the molten steel fed through the pouring spout is supplied at significantly higher casting speeds than were usual for the mold described in the patent. The flow of molten steel is so great that distinct bath surface movements occur, especially in the region between the pouring spout and the longitudinal sides of the mold.

It is known from WIPO patent publication 89/12519 to use pouring spouts whose section for immersion into the melt is shaped like a flattened tube with side walls that run parallel to each other. This wide-mouthed spout section has openings that, alone or together with flow guiding elements, guide the outflow of molten steel from the pouring spout so that individual streams of molten metal intersect each other and thus reduce the flow.

In addition, a pouring spout for introducing molten steel into a mold is described in patent publication 41 42 447 C2 in which the inner wall of the section where the spout cross-section expands and the wall sections opposite thereto of the bottom piece together form flow channels. This pouring spout exercises an influence on the melt that flows through it, and in particular, on the emergence impulse of the casting stream.

When pouring spouts in known shapes are used, the flow of steel creates turbulence and whirlpools, especially in the corner areas in the transverse-side region of the mold. As a result, wave crests and valleys occur in the longitudinal-side region of the pouring spout. The disadvantageous consequence is an uneven supply of slag in the region of the free mold cross-section in the shadow of the pouring spout. This leads to uneven lubrication and irregular heat transfer between the strand shell being formed from the molten steel and the mold wall, which in turn results in slag and casting powder being drawn below the bath surface.

The object of the present invention, therefore, is to provide a pouring spout with a simple design which; breaks-down the Kinetic energy of the molten steel in the region between tile section of the spout immersed into the melt and the longitudinal sides of the mold and to influences in a predeterminable manner the flow formation of the molten steel in the mold in the region of the bath surface.

SUMMARY OF THE INVENTION

The present invention relates to a pouring spout or submerged nozzle for delivering molten steel into a continuous casting mold with longitudinal and transverse sides, particularly for casting thin slabs, which is connected at one end to a casting vessel and at the other end extends so far into the mold that, during casting, the mouth is immersed into the molten steel in the mold. The outer spout wall of the pouring spout has, in its longitudinal-side region facing the longitudinal mold side, a shape that, regardless of the immersion depth of the pouring spout into the melt in the continuous casting mold, has a virtually constant distance to the longitudinal sides of the mold. In addition, the outer spout wall of the pouring spout has, in its transverse-side regions facing the transverse mold sides, form elements that oppose a minimum resistance to the horizontal flow of the molten steel and the casting powder floating thereon.

The outer spout wall of the transverse side of the pouring spout has, in the opening region, a shape that ends in a pointed tip like the hull of a boat. Alternatively, the opening region of the outer spout wall of the pouring spout may have a rectangular shape. In another embodiment of the invention, the outer spout wall of the longitudinal spout side is an area equidistant to the longitudinal side of the mold, and the inner spout wall is a flat area, while the inner spout wall of the pouring spout transverse side has a conical expansion and the angle of inclination of the conical expansion is between 4° and 2 °.

In a preferred embodiment, the distance between the outer spout wall of the pouring spout and the longitudinal mold side to the maximum mold breadth is between 0.15 and 0.3.

Another embodiment of the invention form elements are arranged on the transverse sides of the outer wall of the pouring spout facing the transverse mold sides in the shape of a wedge with the tip pointing against the flow. In a preferred embodiment, the wedge angle of the form element embodied as a wedge is between 30° and 6°.

In still another embodiment the form elements may have a semi-circular outer contour. The form element may alternatively be embodied in the opening region of the pouring spout as a Taylor bulb. In any of these different form element embodiments, the form elements may be independent components which are attached to the outer spout wall of the pouring spout by holding elements. In a preferred embodiment the independent form elements are spaced a distance between 3 mm and 10 mm from the outer spout wall of the pouring spout.

The molten steel emerging from the pouring spout initially moves in the conveying direction of the strand. Depending on the direction of the exit openings in the pouring spout and on the flow speed of the molten steel, the melt moves away from the mouth of the pouring spout to a point at which the flow direction of the molten steel reverses and then, is divided into two individual streams, i.e., flows, in the vicinity of the transverse sides of the mold, opposite to the strand discharge direction and toward the bath surface. In the region of the bath surface, the two separate streams of molten steel move in the direction of the pouring spout. The two streams are diverted at the outer spout walls, which incline toward the transverse sides, and then move into the empty space between the longitudinal side of the mold and the longitudinal side of the pouring spout. The individual molten steel streams, which are moving in the horizontal direction, collide at the level of the central mold axis in the empty spaces located on both sides of the pouring spout and flow off together in the strand discharge direction.

Regardless of the shape of its inner wall, the outer wall of the pouring spout according to the invention is shaped so that, at any desired immersion depth of the spout into the continuous casting mold, the outer spout wall is at a substantially constant distance relative to the longitudinal sides of the mold.

On the transverse sides of the pouring spout, in the region that is immersed into the melt, form elements are provided that offer a minimum resistance to the horizontal flow of the melt in the mold and the casting powder floating thereon. The outer wall of the spout region immersed in the melt may directly produce a minimum flow resistance against the horizontally flowing melt or independent components may be provided which are arranged in front of the transverse side of the pouring spout. The inner wall as well as the outer wall of the pouring spout are shape to that allow optimum flow conditions both in and around the spout. In the case of one-piece pouring spouts, changes in wall thickness will occur. When independent are provided as form elements, immersed pouring spouts with an even wall thickness, based substantially on the shape of the inner wall, are used.

The following are several embodiment of the shapes for the transverse sides of the pouring spout: an embodiment shaped like the hull of a boat, a wedge-shape embodiment, a semicircular embodiment and the so-called "Taylor bulb."

Separate from the aforementioned shapes of the outer wall of the pouring spout, the transverse sides of the inner wall of the spout have a conical expansion or widening preferably with an inclination angle of 4° and 7°. This angle of inclination influences the flow in the region of the casting surface so that the surface flows in a particularly calm manner. The special embodiment of the outer contour of the transverse side of the pouring spout subsequently has an optimum influence on the flow in the empty space between the longitudinal sides of the immersed spout and the longitudinal sides of the mold.

Figure 1A:
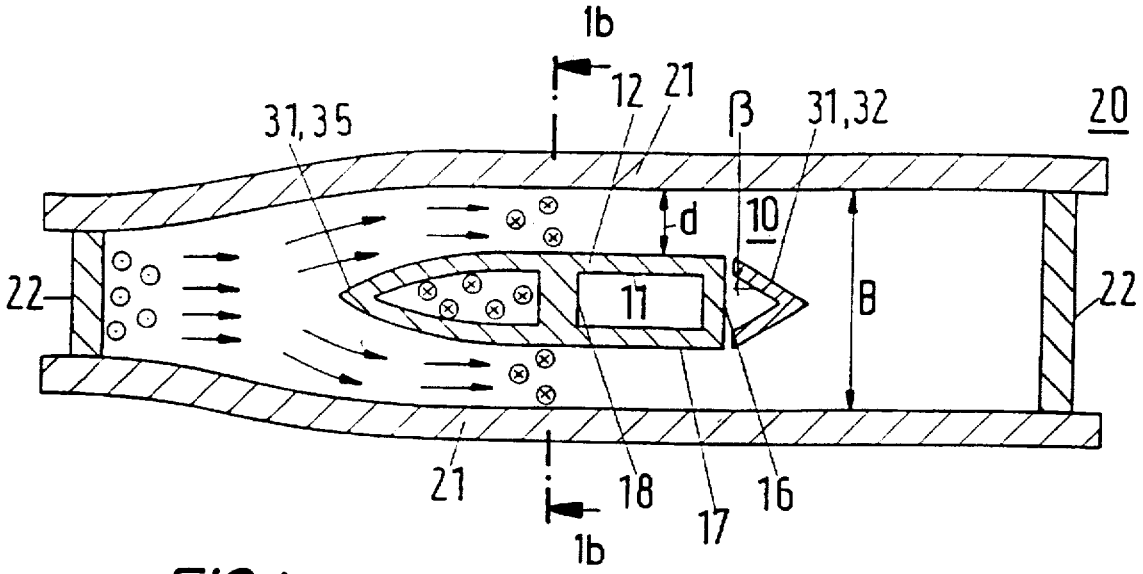
FIG. 1*a* a depicts a transverse cross-sectional view of two embodiments of the mold and pouring spout of the present invention; a first embodiment is shown in the left side of FIG. 1*a* and a second embodiment is shown in the right side of FIG. 1*a*.

DETAILED DESCRIPTION OF THE PRESENTLY PREFERRED EMBODIMENTS.

The figures show a pouring spout 10 with an inner wall 11, an outer wall 12, a region 13 on the casting vessel side and an opening region 14. The region 13 on the casting vessel side is tubular in shape and is connected to a casting vessel (not shown). The opening or mouth region 14 has a substantially crushed or depressed or flattened shape, whose region 16 on the mold transverse side is clearly shorter than the region 17 on the mold longitudinal side.

FIG. 1*a* shows a mold 20 with longitudinal sides 21 and transverse sides 22. Arranged in the center of the mold 20 is tile pouring spout 10. In the first embodiment shown in the right side of FIG. 1*a*, the pouring spout 10 has a rectangular cross-sectional shape. In front of the region 16 on the mold transverse side, there is a form element 31 embodied as a wedge 32 with the tip of the wedge pointing against the direction of flow of the molten steel. The wedge angle 13 of the wedge 32 is between 30° and 60°. The longitudinal sides of the spout are substantially parallel to one another. The outer spout wall 12 is separated from die longitudinal mold side 21 by a distance d and the longitudinal mold sides are separated from one another by a maximum mold breadth B. The distance d between the outer spout wall 12 and the longitudinal mold side 21 to the maximum mold breadth B is preferably between 0.15 and 0.3.

A second embodiment is shown in the left side of FIG. 1*a* in which the pouring spout 10 is shaped;

The left side of the immersed pouring spout 10 (in horizontal section in FIG. 1) is shaped like the hull 35 of a boat. The pouring spout 10 has a wedge-shaped bottom piece 18 in its center. In this embodiment the mold is convex.

Figure 1B:
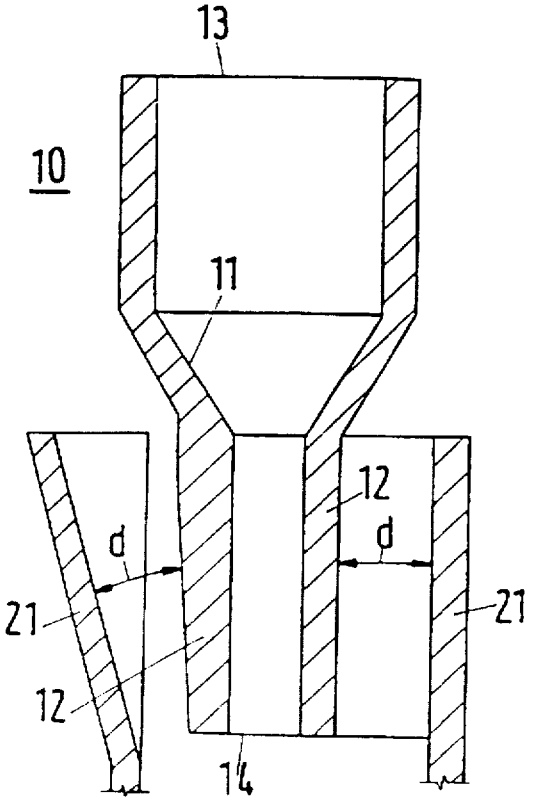
FIG. 1*b* the left side depicts a longitudinal cross-sectional view along line C—C of the first embodiment of FIG. 1*a*; and the right side depicts a longitudinal cross-sectional view along line E—E of the second embodiment of FIG. 1*a*.

The flow of molten material is roughly indicated by the directional arrows shown in the left side of FIG. 1*a*. In the region of the transverse side of the mold, the molten material rises to the bath surface as indicated by arrow tips, i.e., circles with a dot therein. From there, the flow moves toward the immersed pouring spout, evenly divided by the tip of the transverse side of the immersed pouring spout, which is shaped like the hull of a boat. In the center of the longitudinal side of the pouring spout as indicated by arrow ends, i.e., circles with an "x" therein, the molten steel flows in the strand discharge direction. FIG. 1*b* shows longitudinal cross-sectional views through the mold and the spout; and specifically, of a first embodiment along line C—C through the convex mold and of a second embodiment along line E—E through the mold with parallel side walls.

In both embodiments regardless of the shape of the inner wall 11, the outer wall 12 is shape to have a constant distance to the inner wall of the longitudinal mold side 21 at various immersion depths into the mold or the melt.

FIGS. 2*a*, 2*b*, 3*a* and 3*b* show a section through a pouring spout 10 that has, on the side of its opening 14, a conical expansion or wideing 15, in the center of which is a wedge-shaped bottom piece 18. The angle of inclination $\alpha$ of the conical expansion 15 is between 4° and 20°.

Figure 2A:
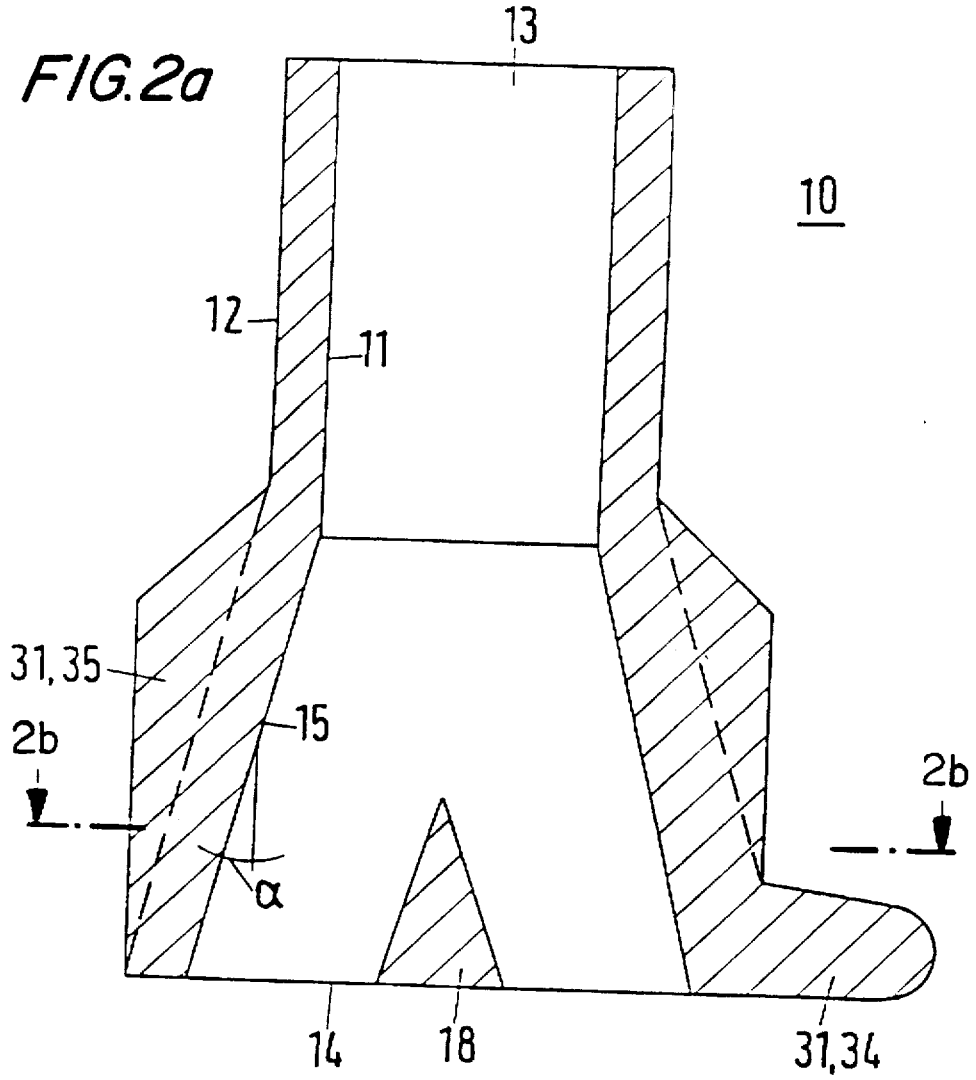
FIG. 2*a* depicts a longitudinal cross-sectional view of another embodiment of the present invention.
Figure 2B:
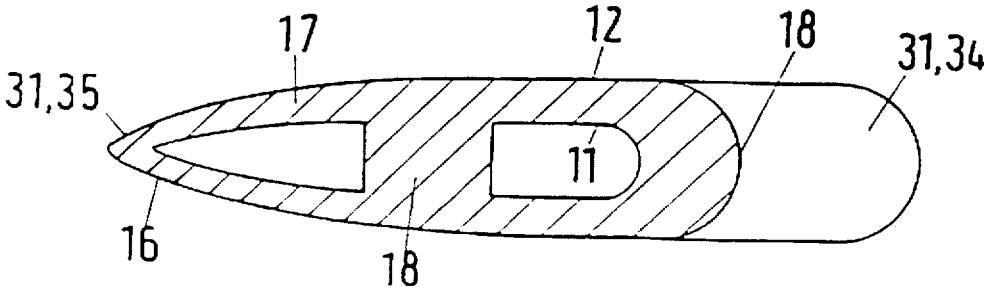
FIG. 2*b* depicts a cross-sectional view of the opening along line A—A of FIG. 2*a*.

In FIGS. 2*a* and 2*b* the outer wall 12 of the pouring spout 10 shape along its transverse side in the region immersed into the melt in such a manner that the horizontal flow of the molten steel and the casting powder floating thereon provides a minimum resistance. On the left side of Figures 2*a* and 2*b*, the outer wall 12 is shaped like the hull 35 of a boat that ends in a pointed tip. On the right side of FIGS. 2*a* and 2*b*, is a Taylor bulb 34, also known from navigation. Both of these form elements may also be embodied with a constant wall thickness of the spout as denoted by the dashed line.

Figure 3A:
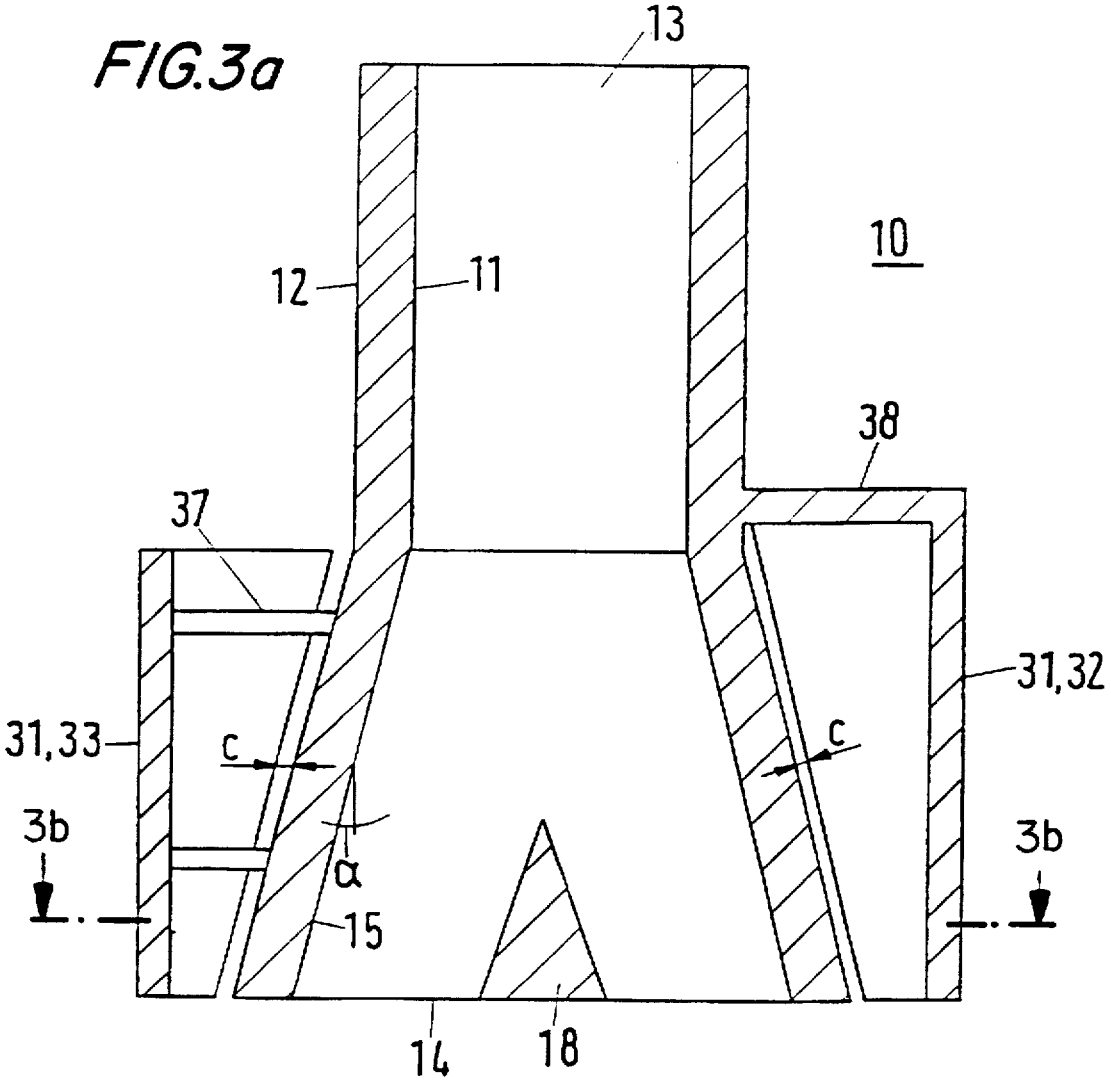
FIG. 3*a* depicts a longitudinal cross-sectional view of another embodiment of the present invention.
Figure 3B:
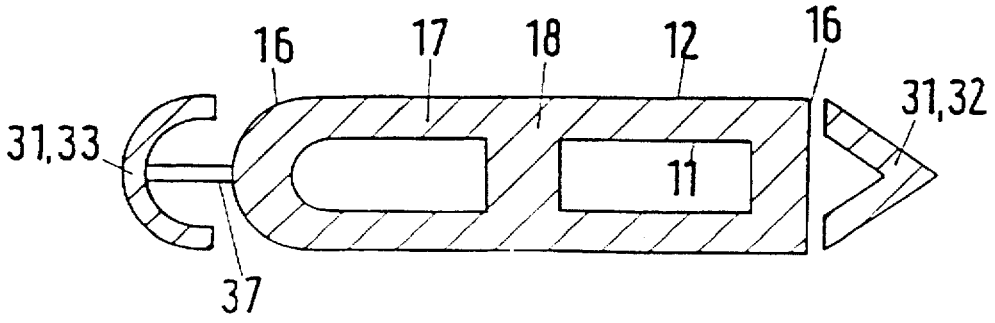
FIG. 3*b* depicts a cross-sectional view of the opening along line B—B of FIG. 3*a*.

FIG. 3*a* shows a pouring spout 10, in which the form elements 31 are embodied as independent components, which are attached to the pouring spout by holding devices 37 is shown on the left side or by a holding piece 38 as shown on the right side. The form elements 31 are separated from the outer spout wall 12 of the pouring spout 10 by a distance c between 3 mm and 10 mm. Pouring spout 10 has a constant wall thickness. The form elements 31 embodied as independent components may have any desired cross-sectional shape. FIG. 3*b* shows a semicircular outer contour 33 on the left side and, on the right side, the shape of a wedge 32.

It is claimed:

1. A pouring spout for delivering molten steel into a continuous casting mold having transverse sides and longitudinal sides defining a maximum mold breadth, said spout having means for connection at one end to a casting vessel and the other end having an opening defined therein for immersion into the molten steel in the mold, said pouring spout comprising:

an outer spout wall including longitudinal sides and transverse sides, the longitudinal sides of said outer spout wall being substantially parallel to the longitudinal sides of the mold regardless of an immersion depth of said pouring spout into the molten steel in the mold; and form elements being disposed in a region between the transverse sides of said outer spout wall and the transverse sides of the mold and facing the transverse sides of the mold so that said form element provide a minimum resistance a horizontal flow of the molten steel and casting powder floating thereon.

2. The pouring spout in accordance with claim 1, wherein the transverse side of said outer spout wall in a region of the opening is tapered with a pointed tip end.

3. The pouring spout in accordance with claim 1, wherein the transverse side of said outer spout wall in a region of the opening is rectangularly shaped.

4. The pouring spout in accordance with claim 1, further comprising an inner spout wall surrounded by said outer spout wall; the longitudinal sides of said outer spout wall being parallel to the longitudinal sides of the mold and parallel to the inner spout wall.

5. The pouring spout in accordance with claim 4, wherein the inner spout wall conically widens towards the opening at an angle of inclination of between 4° and 20°.

6. An assembly for delivering molten steel. Comprising:

a continuous casting mold having transverse sides and longitudinal sides defining maximum mold breadth:

a pouring spout for delivering molten steel into said mold, said spout being connectable at one end to a casting vessel and the other end having an opening defined therein for immersion into the molten steel in said mold, said pouring spout comprising:

an outer spout wall including longitudinal sides and transverse sides, the longitudinal sides of said outer spout wall being substantially parallel to the longitudinal sides of the mold regardless of an immersion depth of said pouring spout into the molten steel in the mold: and form elements being disposed in a region between the transverse sides of said outer spout wall and the transverse sides of the mold and facing the transverse sides of the mold so that said form element provide a minimum resistance a horizontal flow of the molten steel and casting powder floating thereon:

wherein the distance between the longitudinal side of said outer spout wall and the longitudinal side of the mold to the maximum mold breadth is between 0.15 and 0.3.

7. The pouring spout in accordance with claim 1, said form elements being shaped as a wedge and disposed on said outer spout wall of said pouring spout facing the transverse sides of lie mold with a tip of the wedge pointing against a direction of flow of the molten steel.

8. The pouring spout in accordance with claim 7, the wedge-shaped form elements defining a wedge angle of between 30° and 60 .

9. The pouring spout in accordance with claim 1, said form element having a semicircular shape.

10. The pouring spout in accordance with claim 1, said form element being shaped as a Taylor bulb.

11. The pouring spout in accordance with claim 1, said form elements comprising independent components mounted to said outer spout wall of said pouring spout by holding elements.

12. The pouring spout in accordance with claim 11, the independent components being separated from said outer spout wall of said pouring spout by a distance of between 3 mm and 10 mm.

* * * * *